United States Patent [19]

Calvert

[11] 4,295,598

[45] Oct. 20, 1981

[54] CARTON WITH CARRYING STRAP

[75] Inventor: Rodney K. Calvert, Dunwoody, Ga.

[73] Assignee: The Mead Corporation, Dayton, Ohio

[21] Appl. No.: 161,408

[22] Filed: Jun. 20, 1980

[51] Int. Cl.[3] ..... B65D 5/46; B65D 25/28

[52] U.S. Cl. ..... 229/52 AL; 229/41 B; 220/94 R; 206/142; 206/428

[58] Field of Search ..... 229/52 A, 52 AE, 52 AC, 229/52 BC, 40, 41 B; 206/142, 427, 428, 435; 220/94 R, 94 B

[56] References Cited

U.S. PATENT DOCUMENTS

| | | | |
|---|---|---|---|
| 1,771,766 | 7/1930 | Berney | 229/52 AC |
| 2,028,085 | 1/1936 | Brunt | 229/52 AC |
| 2,089,831 | 8/1937 | Henriksen | 229/52 AC |
| 2,522,391 | 9/1950 | McGonigle | 220/94 R |
| 2,640,645 | 6/1953 | Brown | 229/52 A |
| 2,645,405 | 7/1953 | Dorfman | 229/41 B |
| 2,783,690 | 3/1957 | Crary | 206/428 |
| 2,896,838 | 7/1959 | Struble | 229/52 AC |
| 3,039,670 | 6/1962 | Hardon | 229/41 B |
| 3,801,012 | 4/1974 | Thelen | 229/52 AC |
| 3,848,766 | 11/1974 | Ganti | 220/94 R |

FOREIGN PATENT DOCUMENTS

| | | | |
|---|---|---|---|
| 272402 | 6/1927 | United Kingdom | 229/52 AC |

*Primary Examiner*—Herbert F. Ross

*Attorney, Agent, or Firm*—Rodgers & Rodgers

[57] ABSTRACT

A carton for accommodating beverage containers and the like includes a carrying strap comprising an endless band which includes a part anchored internally of the carton by being looped around one or more of the containers and an exposed handle part located adjacent one end of the carton which part can be grasped to lift and carry the carton.

15 Claims, 6 Drawing Figures

CARTON WITH CARRYING STRAP

TECHNICAL FIELD

The invention relates to a carton for accommodating a number of discrete articles, in particular beverage containers such as bottles or cans and in which a separate carrying strap is included which is anchored within the carton solely by engagement with one or more of the articles.

BACKGROUND ART

U.S. Pat. No. 3,904,036 issued Sept. 9, 1975 and owned by the assignee of this invention discloses an enclosed bottle container in which the top panel is provided with hand gripping apertures to facilitate carrying the package.

The current trend toward packaging large numbers of primary packages such as one or two dozen items in a secondary container has resulted in a need for an improved carrying device for such packages. One example of a package having a carrying strap is disclosed in French patent application No. 7,825,707 filed Sept. 1, 1978. In this French patent application a carrying strap is disposed about the exterior of a package such as a carton formed of paperboard and the carrying strap is anchored in slits formed at the carton corners. In a modification of the invention of this French patent application, a carrying strap is inserted through opposed side walls and between two rows of packaged articles and is looped about the outer surfaces of these opposed walls and an interconnecting wall to form a carrying strap. Obviously the carrying straps of this French patent application are not securely related with the associated container and are very difficult to apply to the carton particularly in the case of the strap that must be inserted through opposed side walls and between adjacent rows of packaged items.

DISCLOSURE OF INVENTION

According to the invention in one form an easily applied, sturdy carrying strap is incorporated into a carton for accommodating articles such as beverage containers which carton comprises a top wall and a bottom wall both of which are foldably joined to and spaced apart by a series of connecting walls comprising side walls and end walls forming an enclosure of generally cubical configuration, and a carrying strap having a handle part located adjacent one of said connecting walls which handle part is positioned to be grasped for carrying the carton, and having an anchored part disposed entirely within the carton and anchored therein solely by engagement with at least one article within the carton.

According to a feature of this aspect of the invention the carrying strap preferably comprises an endless band and the anchored part is provided by a portion of said band within the carton which is looped around the article such that the article is bounded between said looped portion and said one connecting wall. If desired, a multiplicity of articles may be accommodated within the carton with the endless band being looped around a plurality of said articles such that said plurality is bounded between the looped portion and said one connecting wall and others of said articles are accommodated outside said looped portion.

Another aspect of the invention provides a blank for forming a carton having a top wall, a bottom wall and spaced side walls foldably joined to said top and bottom walls for forming a generally cubical construction, and wherein the blank includes an end closure structure comprising top and bottom wall end panels foldably joined to said top and bottom walls respectively, and side wall flaps foldably joined to respective ones of said side walls, and wherein one of said end panels is formed with an elongate slot extending longitudinally of the blank and each of said side wall flaps is formed with an aperture sized and positioned so as to register with said elongate slot when the end closure structure is completed.

BEST MODE OF CARRYING OUT THE INVENTION

Figure 2:
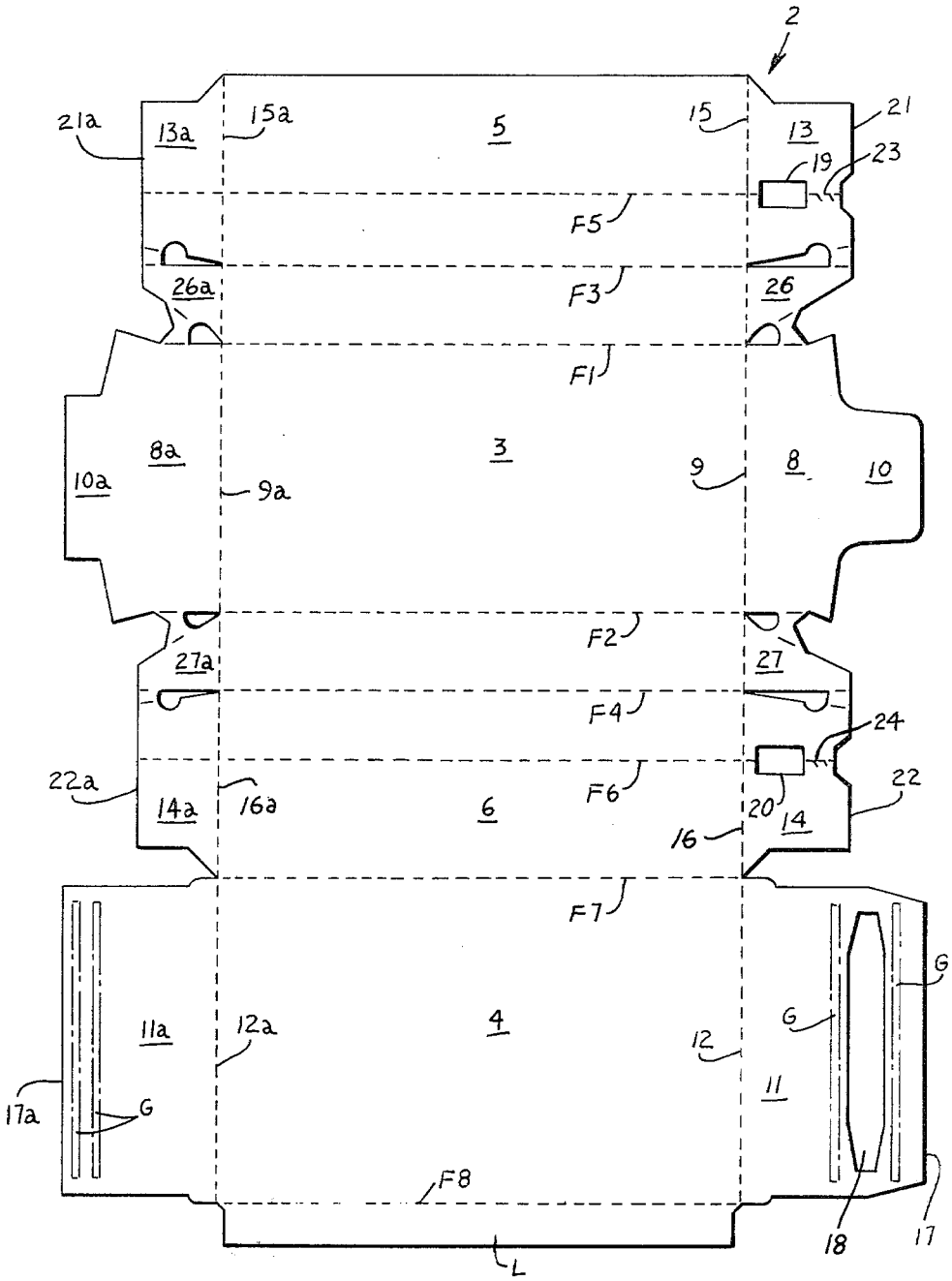
FIG. 2 is a plan view of a blank for forming a carton according to the invention.

Referring to the drawings, a carton 1 is formed from a paperboard blank 2 or other similar foldable sheet material. As is best shown in FIG. 2, top wall 3 is foldably joined along fold line F1 to side wall 5 and is foldably joined along fold line F2 to side wall 6. Bottom wall 4 is foldably joined to the bottom edge of side wall 6 along fold line F7 and glue flap L is foldably joined to a side edge of bottom wall 4 along fold line F8.

While the invention is not limited for use in packaging bottles having tapered neck portions, the carton shown in the drawings is especially adapted for use in conjunction with bottles. Thus side walls 5 and 6 are provided with fold lines F3 and F4 respectively so as to allow the upper portion of these side walls to tilt inwardly and thereby to accommodate the difference in width of the top wall 3 and the bottom wall 4.

Figure 1:
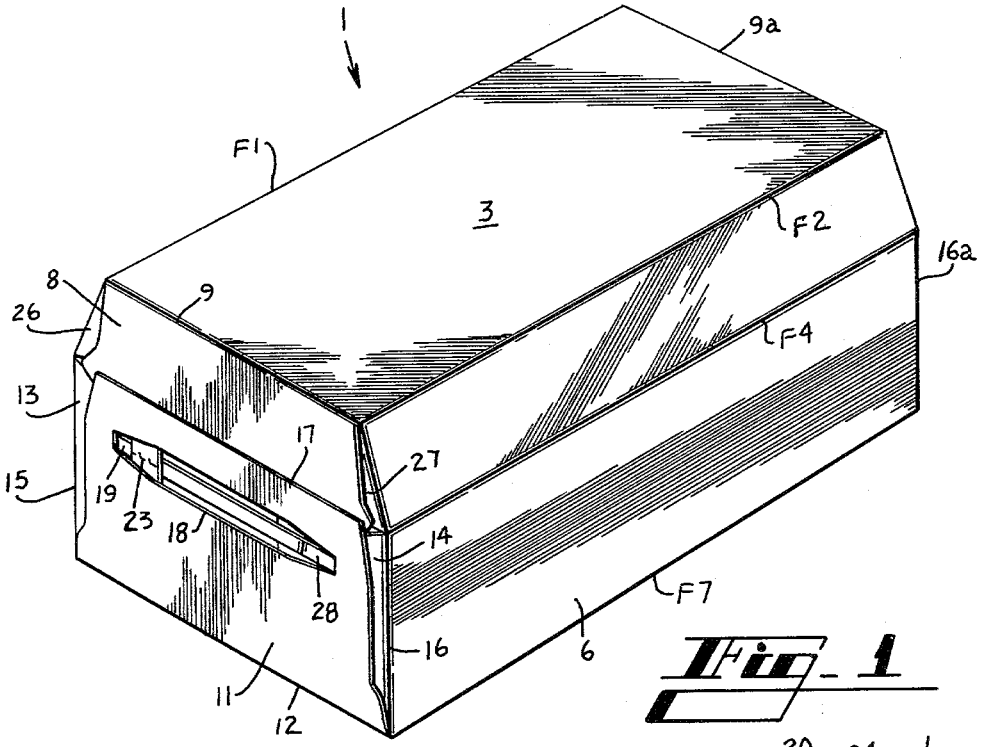
FIG. 1 is a perspective view of a package formed according to this invention.
Figure 3:
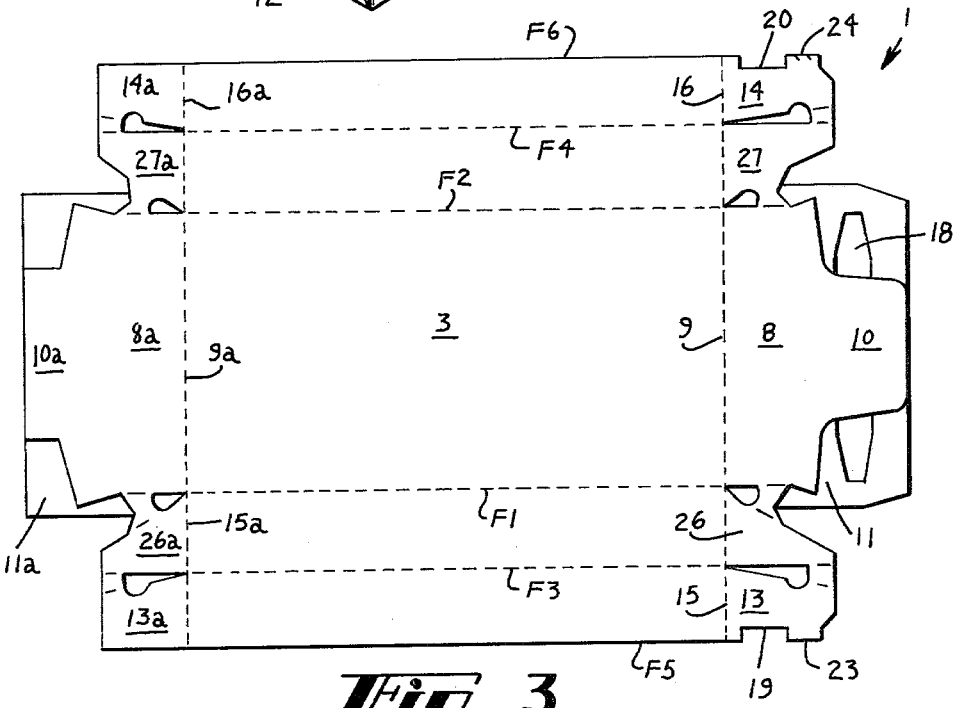
FIG. 3 is a collapsed carton formed from the blank of FIG. 2 as supplied by the manufacturer to the packages.

In order to form a sleeve from the blank shown in FIG. 2, the blank is folded along the fold lines F5 and F6 and into the condition represented by FIG. 3. The carton is secured in this condition by means of glue applied to glue flap L which causes that flap to become adhered to the portion of side wall 5 which is disposed at the right hand end of the blank as the blank is viewed in FIG. 2. The carton is in this condition when completed by the manufacturer and shipped to the packager.

The packager sets up the collapsed blank as shown in FIG. 3 into an open ended sleeve as is well known. Groups of containers such as bottles B are loaded into the open ends of the set up sleeve following the application of a carrying strap to one group of bottles prior to loading through one end of the sleeve.

Figure 6:
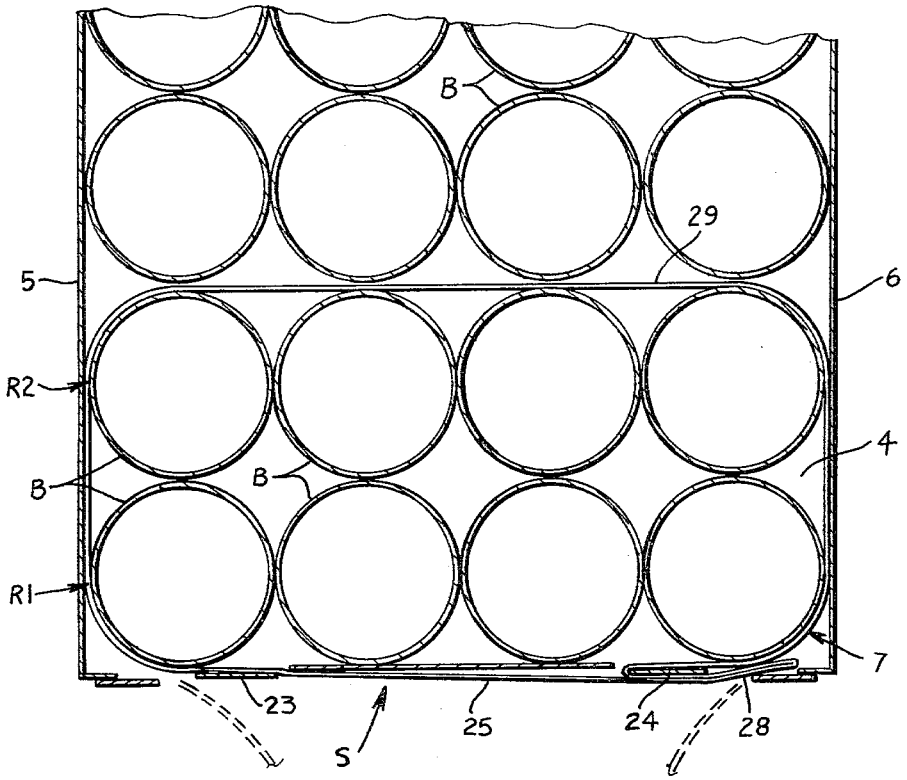
FIG. 6 is a scrap section taken along the line 6—6 in FIG. 4.

As best seen in FIG. 6 of the drawing the bottles B are arranged within the carton in a number of rows of which rows R1, R2 are bounded by carrying strap 7 which is applied immediately prior to loading those rows into one end of the carton sleeve. The carrying strap 7 is preformed and applied by a suitable machine as described and claimed in co-pending U.S. patent application Ser. No. 160,222 owned by the assignee of the present invention and filed on June 17, 1980. Strap 7 comprises a strip of plastic material which is ultrasonically welded or otherwise formed into an endless band and subsequently looped around two rows R1, R2 of bottles prior to loading.

The end closure structure S of the carton adjacent bottle rows R1, R2 comprises a top wall end panel 8 foldably joined to the top wall 3 about a longitudinal fold line 9. The end panel 8 has its free edge shaped to provide a tongue 10. The end closure structure S further includes bottom wall end panel 11 foldably joined to the bottom wall 4 along a longitudinal fold line 12 and side wall flaps 13, 14 foldably joined to side walls 5, 6 along longitudinal fold lines 15, 16 respectively.

The end panel 11 has formed therein adjacent its longitudinal free edge 17 an elongate slot 18 through which a handle part of the strap 7 is exposed. Each of the side wall flaps 13, 14 is formed with a generally rectangular aperture 19, 20 respectively which is isolated from the free longitudinal edge 21, 22 of the flap by a breakable strip 23, 24 respectively. Each is formed by perforating the area of paperboard located between the aperture and the free longitudinal edge of the end flap.

After the carton has been loaded so that the bottle rows R1, R2 are positioned with their tops and bases in abutment with top and bottom walls 3,4 respectively and adjacent the end closure structure S, a handle part 25 of the looped carrying strap is located at the open end of the sleeve. In order to close the end structure S an application of glue is applied across the bottom wall end panel 11 on either side of the elongate slot 18 in the areas indicated at G in FIG. 2. The side wall flaps 13,14 are then folded inwardly towards one another about fold lines 15, 16 respectively so that breakable strips 23, 24 overlie the handle part 25 of strap 7 and top wall end panel 8 is folded downwardly about fold line 9 into overlapping relationship with the side wall flaps 13, 14. Thus, the end panel 8 is positioned in cooperation with the carrying strap such that the tongue 10 is located between the central bottles of row R1 and the handle part 25 of carrying strap 7 to provide a backing panel for the handle part 25. It is apparent from FIG. 2 that the top wall end panel 8 is connected to each of side wall flaps 13,14 by means of gusset panels 26, 27 respectively. Such gusset panels are of known construction and have the effect of coordinating downward closing movement of the top wall end panel 8 automatically during inward folding of side wall flaps 13, 14.

Figure 4:
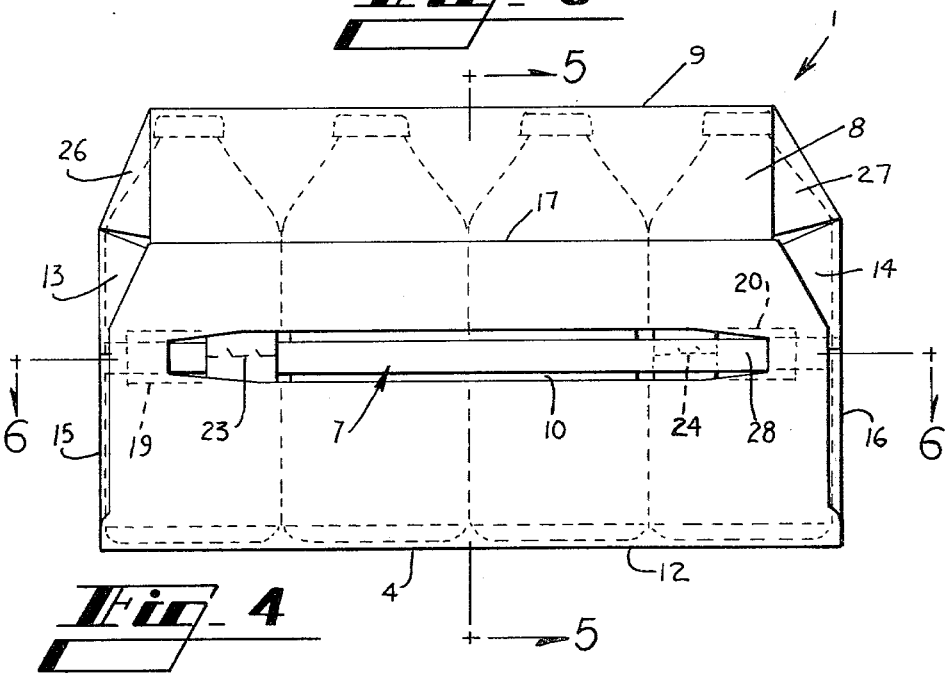
FIG. 4 is an end view of the filled and completed carton incorporating a carrying strap.

The bottom wall end panel 11 is then folded upwardly about fold line 12 into overlapping relationship with top wall end panel 8 and adhered thereto to complete the end closure S. Referring to FIG. 4 it is apparent that the handle part 25 of the carrying strap 7 is positioned such that when the end closure S is completed, the handle part 25 is exposed to view and extends across the slot 18 in bottom wall end panel 11. Moreover, the apertures 19, 20 are sized and positioned so as to register with the slot 18 at the extremities thereof so that the breakable strips 23, 24 extend across slot 18 adjacent the extremities and in overlapping relationship with the handle part 25 of the carrying strap 7. This feature permits the handle part to be moved outwardly away from close proximity with bottle row R1 which it normally occupies. This outward movement is achieved in use when the handle part 25 is grasped to lift the carton which causes breakable strips 23, 24 to break thus allowing the handle part to move towards the extremities of slot 18 and outwardly from the end closure to a carrying position as indicated in dotted lines in FIG. 6. In order to provide a satisfactory length for carrying purposes and to enhance the outward movement, the handle part 25 includes a folded portion 28 doubled back on itself and overlapped outwardly of the breakable strip 24. The folded portion normally is stowed within the carton behind end flap 13 as best seen in FIG. 6 of the drawings. Hence, when the handle part 26 is grasped, the folded portion 28 unfolds to provide an increased length of the strip at the handle part 25 after which breakage of the breakable strips occurs as described above so that the handle adopts the extended position shown in phantom lines in FIG. 6.

The opposite end closure of the carton is closed in a similar manner to complete the carton except in that structure no provision is made for a carrying handle and parts which correspond generally with the elements of closure S are designated with corresponding numerals to which the letter "a" is added.

Figure 5:
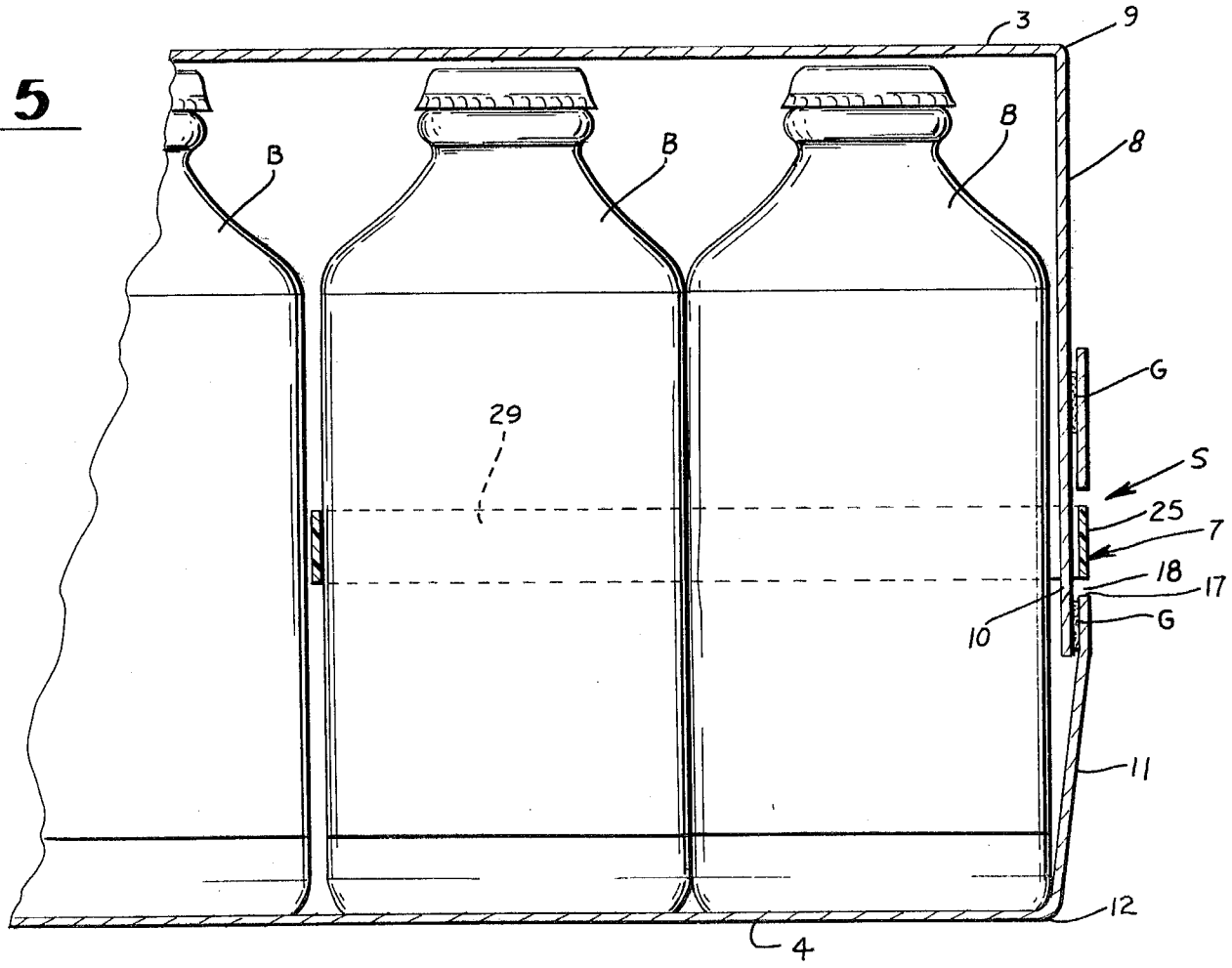
FIG. 5 is a scrap section taken along the line 5—5 in FIG. 4.

The carrying handle 7 thus includes an internally looped anchored part 29 located entirely within the carton and a carrying part 25 located adjacent one end closure structure S of the carton. It will be seen from FIGS. 5 and 6 that the anchored part 29 extends transversely of the carton and passes along the inner surface of carton side walls 5, 6 towards the carton end S to provide the handle part. The bottles in rows R1, R2 therefore are bounded between the internal looped portion 29 of the carrying strap and the end closure structure S of the carton. In this way some of the bottles within the carton represented by those constituting rows R1 and R2 are used to secure the carrying strap of the carton so that the carton weight is transferred to the end closure structures through bottle rows R1, R2 when the carton is lifted by the carrying strap. Thus the bottles B are carried on their sides.

The internally looped part 29 of the carrying strap 29 may be passed around a group of bottles having more or less bottles than those illustrated and moreover the construction also is applicable to a carton having only one article accommodated therein. It is contemplated that the end closure structure could be modified and the overlapping relationship of the various panels altered. For example, the slot 8 could be formed in the top wall end panel 8.

It also is contemplated that the carrying strap could be arranged to have its handle part located adjacent one of the other walls of the carton, e.g. a side wall by suitably modifying the construction.

INDUSTRIAL APPLICABILITY

The invention is particularly well adapted for use in conjunction with secondary packages for packaging large numbers of primary packages of consumer items.

I claim:

1. An article carton having top, bottom, side and end walls interconnected to form an enclosure which is generally cubical in configuration, means defining an aperture in one of said walls, and a carrying strap having an anchoring part disposed entirely within the carton and arranged in enveloping relation to at least a part of an article disposed within the carton, said strap having a handle part normally disposed within the carton and adjacent said aperture and said handle part being accessible for grasping to facilitate carrying the carton.

2. A carton according to claim 1 wherein said carrying strap is endless and said anchoring part is arranged to urge said article toward engagement with said one wall during portage of the carton.

3. A carton according to claim 1 wherein a plurality of articles are arranged in rectilinear configuration and wherein said anchoring part of said strap is arranged about some of the articles and includes a part extending between opposed walls, and connecting parts extending along the inside surfaces of said opposed walls and toward said one wall.

4. A carton according to claim 1 wherein said one wall is an end wall of the carton and wherein said aperture is of elongate configuration.

5. A carton according to claim 3 in which each of said articles has a top and a base located adjacent said top and bottom walls respectively and in which said carrying strap is located generally midway between said top and bottom walls so that said looped portion is centrally located with respect to said carton.

6. A carton according to claim 4 in which said handle part includes a length of said strap located adjacent said aperture and in close proximity with said article.

7. A carton according to claim 6 in which said aperture comprises an elongate slot extending transversely of said one end wall and wherein a breakable strip is provided adjacent each end of said slot, each of said breakable strips being located so as to overlap portions of said carrying part of said strap such that said breakable strips are caused to break when the handle part is grasped and the carton lifted thereby permitting said handle part to move outwardly from close proximity with said article.

8. A carton according to claim 7 in which said handle part includes a folded portion doubled back on itself so that the said handle part is extensible when said portion is unfolded by grasping said handle portion to lift the carton, said folded portion normally being stowed at least partially within the carton.

9. A carton according to claim 1 in which said carrying strap comprises a strip of plastic material of substantially constant thickness.

10. A carton according to claim 8 in which said one end wall comprises an end closure structure having top and bottom wall end panels foldably joined to the ends of said top and bottom walls respectively, and side wall flaps foldably joined to the ends of said side walls respectively, said side wall flaps being folded inwardly and said end panels being folded to overlap said side wall flaps and one another and wherein one of said end panels at one end of the carton is formed with said elongate slot and each of said side wall flaps at said one end of the carton is formed with one of said breakable strips extending across said elongate slot, said handle portion of the carrying strap extending along said slot and being overlapped by said breakable strips.

11. A carton comprising top, bottom, side and end walls foldably joined to form a generally cubical structure one of said end walls including top and bottom wall end panels foldably joined to one end of said top and bottom walls respectively, and side wall flaps foldably joined to corresponding ends of said side walls, one of said end panels being formed with an elongate slot and each of said side wall flaps being formed with an aperture sized and positioned so as to register with said elongate slot when the carton is set up in completed condition.

12. A carton according to claim 11 in which each of said side wall flaps at said one end of the carton includes a tearable strip normally isolating its aperture from the outer edge of the flap and wherein each aperture is caused to communicate with said edge when the strip is torn away to provide a recessed notch in the flap extending inwardly from said edge.

13. A carton blank comprising a bottom wall, end wall panels foldably joined to the ends of said bottom wall, an elongate aperture formed in an end wall panel at one end of said bottom wall, a side wall foldably joined to a side edge of said bottom wall, end flaps foldably joined to the ends of said side wall, a registerable aperture formed in an end flap at the end of said side wall corresponding to said one end of said bottom wall, and a tearable strip extending from said registerable aperture to the outer edge of the associated end flap.

14. A blank according to claim 13 wherein a fold line is formed in said side wall and disposed in alignment with said registerable aperture and with said tearable strip.

15. A blank according to claim 13 wherein said elongate aperture is spaced from said one end of said bottom panel a distance which is approximately equal to the distance by which said registerable aperture is spaced from an imaginary extension of the bottom edge of said side wall.

* * * * *